United States Patent [19]

Timmes et al.

[11] Patent Number: 4,762,139

[45] **Date of Patent: * Aug. 9, 1988**

[54] PORTABLE SAILBOARD FRAME

[76] Inventors: Daniel Timmes; Christopher G. Thornton, both of 535 Seabright La., Solana Beach, Calif. 92075

[ * ] Notice: The portion of the term of this patent subsequent to Mar. 8, 2005 has been disclaimed.

[21] Appl. No.: 806,410

[22] Filed: Dec. 9, 1985

[51] Int. Cl.[4] ..... B08B 3/02

[52] U.S. Cl. ..... 134/199; 134/201; 211/127; 239/279

[58] Field of Search ..... 134/198, 199, 201; 211/127; 239/279, 280, 289; 138/103, 108

[56] References Cited

U.S. PATENT DOCUMENTS

| | | | |
|---|---|---|---|
| 1,183,391 | 5/1916 | Mason | 239/280 X |
| 1,842,099 | 1/1932 | Johnson | 134/198 X |
| 2,586,620 | 2/1952 | Hart | 134/199 X |
| 2,665,171 | 1/1954 | Stievater | 239/280 |
| 2,751,915 | 6/1956 | Roberts | 134/199 X |
| 3,072,131 | 1/1963 | Laurenzio | 134/199 X |
| 3,353,546 | 11/1967 | Mahoney | 134/199 X |
| 3,511,252 | 5/1970 | Kennedy | 134/1970 X |

FOREIGN PATENT DOCUMENTS

| | | | |
|---|---|---|---|
| 22963 | 11/1956 | Fed. Rep. of Germany | 134/123 |

*Primary Examiner*—Harvey C. Hornsby
*Assistant Examiner*—Frankie L. Stinson
*Attorney, Agent, or Firm*—Charmasson & Holz

[57] ABSTRACT

A portable sailboard frame comprised of an upper tubular structure and a lower supporting rack which can be assembled and disassembled because of its modular features. The frame is also multifunctional and facilitates the maintenance of sailboards, surfboards and similar craft.

2 Claims, 2 Drawing Sheets

PORTABLE SAILBOARD FRAME

BACKGROUND OF THE INVENTION

This invention relates to a frame, and more particularly, to a portable sailboard frame to facilitate maintenance of sailboards, surfboards and similar craft.

Windsurfing is a relatively new water sport which has enjoyed tremendous popularity since the early 1970s. Such sailboards like other recreational vehicles require thorough cleaning and maintenance. Presently, however, there is no known apparatus to aid in the maintenance of such craft.

SUMMARY OF THE INVENTION

It is an object of the present invention to provide a frame which can be assembled and disassembled. Because the instant frame is modular in construction, it is portable. Therefore, the frame can be easily transported.

Another object of the invention is to provide a portable frame which is multifunctional. That is, the instant invention can be utilized for washing, rinsing, drying, storing, and repairing of sailboards, surfboards, and similar structures.

For the preferred embodiment of the invention, a portable sailboard frame comprises an upper structure assembled from tubular sections, a lower supporting structure to hold at least one sailboard, and a number of jets placed along the upper structure to spray the craft. The structural elements of the frame are positioned in an efficient configuration to support each component of sailboard equipment. Thus, the frame functionally provides for every phase of maintenance activity upon the initial placement of the equipment onto the frame.

DESCRIPTION OF THE PREFERRED EMBODIMENT OF THE INVENTION

Although the present invention is described in connection with maintenance applications for recreational craft, it is to be understood that the invention is not limited thereto.

Figure 1:
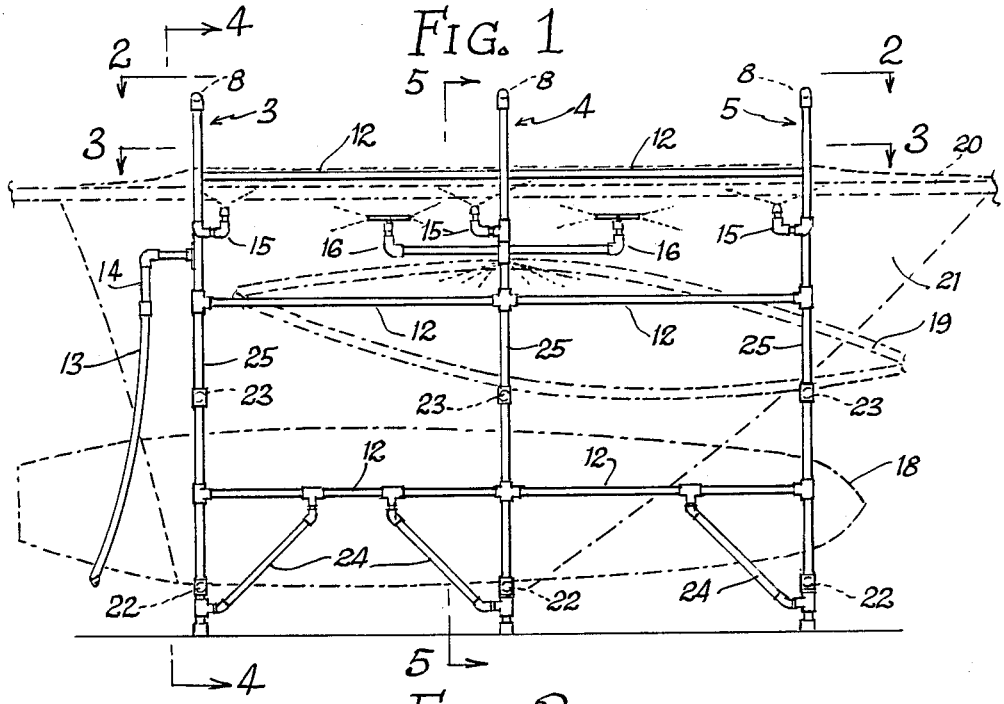
FIG. 1 is a vertical side elevational view of the portable sailboard frame showing the board, boom, and sail in phantom lines placed in the corresponding receiving areas of the frame.
Figure 2:
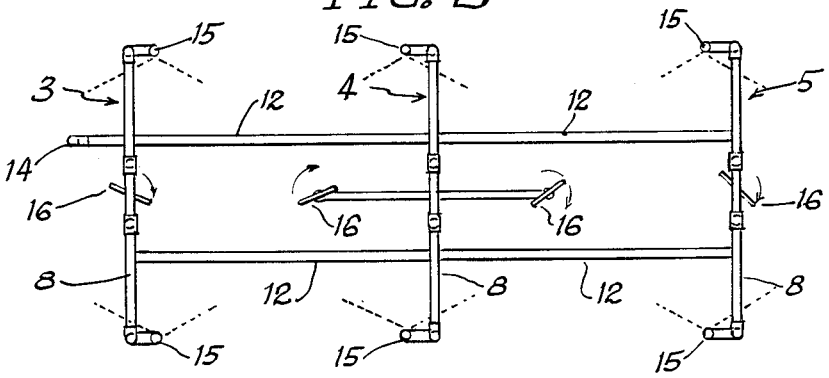
FIG. 2 is a top plan view of the frame.
Figure 3:
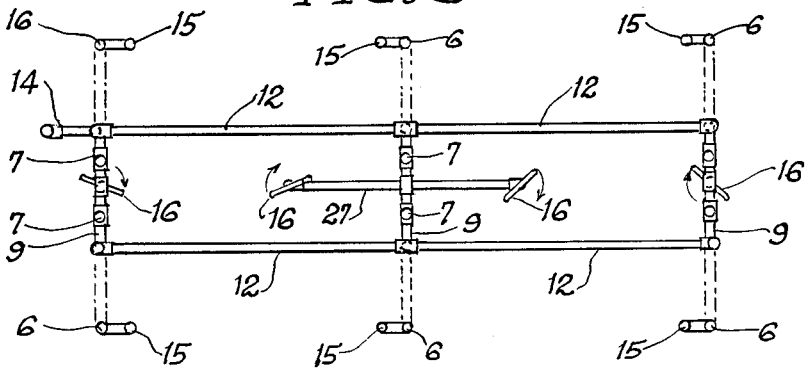
FIG. 3 is a sectional top view of the frame taken along line 3—3 of FIG. 1.
Figure 4:
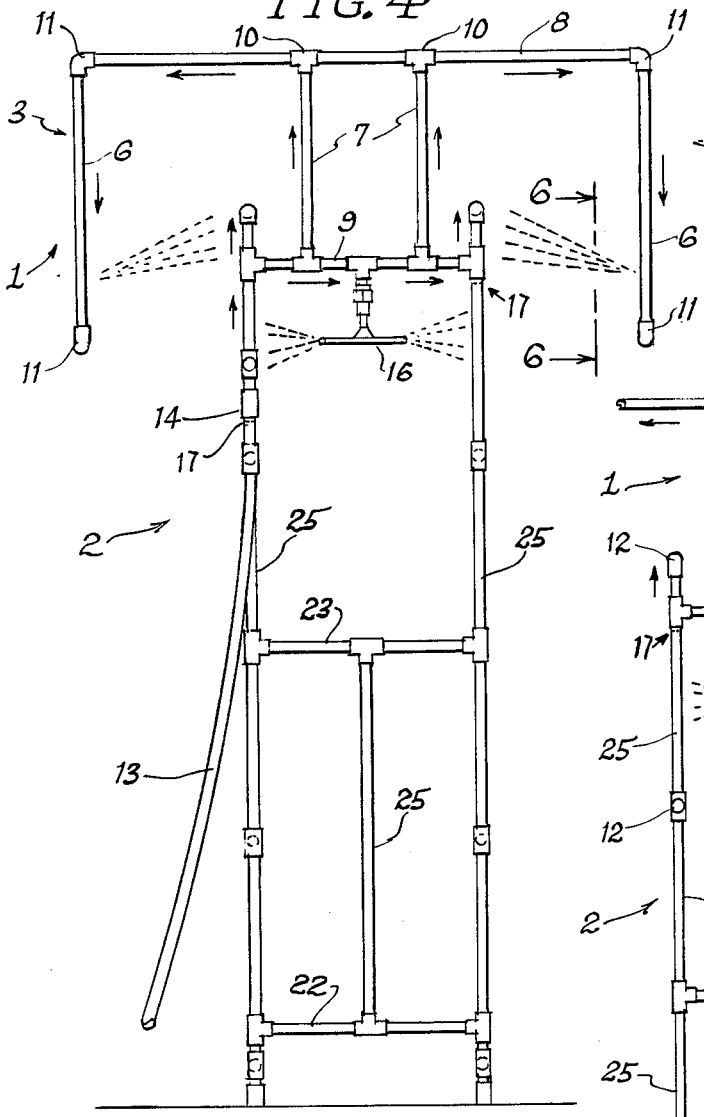
FIG. 4 is a vertical end view of the frame taken along line 4—4 of FIG. 1.
Figure 5:
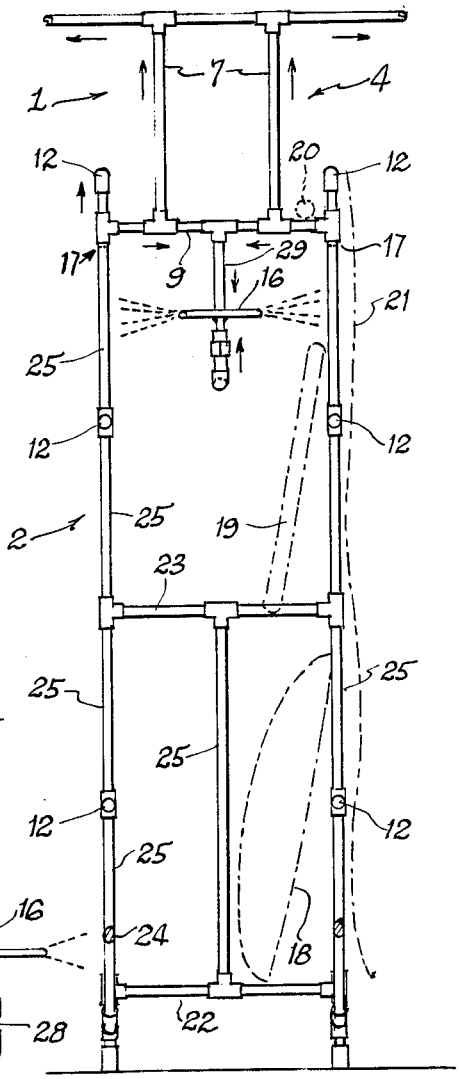
FIG. 5 is a sectional vertical end view of the frame taken along line 5—5 of FIG. 1 showing the middle section and showing a sailboard, boom and sail in phantom lines.

FIGS. 1 through 7 show a preferred embodiment of the portable sailboard frame. More particularly, FIGS. 1 through 5 show that the frame comprises an upper structure 1 which is attached to a lower supporting structure 2. Upper structure 1 is comprised of three tubular sections 3, 4, 5, which are shown in FIGS. 1, 2, and 3. FIGS. 4 and 5 show that each section 3, 4, 5 is further comprised of two pairs of parallel vertical members 6, 7.

Moreover, these vertical members 6, 7 are attached to horizontal cross members 8, 9. Sections of horizontal cross members 8, 9 are coupled together by tees 10. Tees 10 then interconnect the horizontal cross members 8, 9 to the inner vertical members 7. The ends of the horizontal cross member 8 are coupled by elbows 11 to the outer vertical members 6. Finally, sections 3, 4, 5 are held together by a plurality of side members 12. Side members 12 have been designed such that each end thereof includes a hose adapter and a transition nipple. This design feature facilitates the assembly and disassembly of the frame by enabling one to keep the vertical sections in the same position relative to each other. Most of the other components of the present invention also include the hose adapter and transition nipple assembly and this feature makes the sections of the frame portable.

In a typical application shown in FIG. 1, water is sent through the tubular upper structure 1 by attaching a hose 13 to hose adapter inlet 14. Water then flows through the upper structure 1 to jets 15, 16. In FIG. 4, plugs 17 are provided at lower ends of the structure 1 to prevent water from entering the lower supporting structure 2. This arrangement also helps to conserve water and maximize fluid pressure throughout the upper frame 1. The arrows in FIGS. 4, 5, and 7 indicate the direction in which water flows as it moves through the tubular upper structure 1. For other applications of the present invention more fully described below, the upper frame may be alternatively configured without the jets if water is not required.

Turning now to FIG. 5, the lower structure 2 is comprised of a plurality of vertical support bars 25, and is designed to support at least one sailboard 18, boom 19 and mast 20. The height of lower structure 2 is dimensioned such that when mast 20 is placed onto the lower cross members 9, then in most applications sail 21 need not be separated from mast 20 and can be hung without touching the ground.

Lower supporting structure 2 is further designed such that base cross member 22 is positioned to support sailboard 18 and middle cross member 23 is positioned to support boom 19.

Moreover, FIG. 1 shows braces 24 placed near the bottom of supporting structure 2. In addition, vertical support bar 25 shown in FIG. 5 is placed between the base cross member 22 and middle cross member 23. It should be remembered that this particular configuration of the preferred embodiment, along with other arrangements herein, is for illustrative purposes only. Structural variations are possible and are within scope of the principles described herein.

Figure 6:
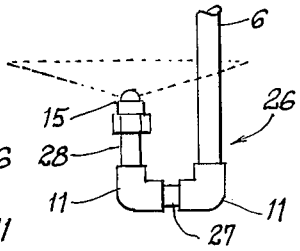
FIG. 6 is a detail view of a jet and support arm assembly taken along line 6—6 of FIG. 4.
Figure 7:
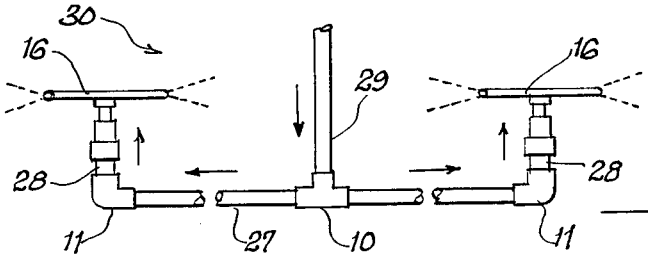
FIG. 7 is a partial detail view of a rotating jet and support arm assembly.

Next, FIG. 6 shows details of the jet and support arm assembly 26 which is attached to vertical sections 3, 4 and 5. Assembly 26 is connected at the lower ends of vertical member 6 and consists of connecting rod 27, elbows 11, riser 28, and jet 15. Finally, FIG. 7 shows a partial detail view of rotating jet and support arm assembly 30, which is attached to center vertical section 4. Center jet assembly 30 consists of vertical member 29, connecting rod 27, elbows 11, tee 10, riser 28, and rotating jet 16. By utilizing risers 28 in assembly 26, the height of jets 15 is adjustable.

Although two rotating jets 16 are included in center section 4, only one of these jets is provided at end sections 3 and 5. In center section 4, the top end of vertical member 29 is attached to lower cross member 9. In comparison, rotating jet 16 is directly attached to lower cross member 9 in sections 3 and 5. Unlike in end vertical sections 3 and 5, however, connecting rod 27 is positioned perpendicular to the plane of center section 4 as shown in FIGS. 1, 2 and 3. This allows rotating jets 16 to be positioned along the length of sail 21. Consequently, water sprayed from the rotating jets 16 reach substantially all areas of sail 21. Thus, because stationary jets 15 and rotating jets 16 are placed along the upper structure 1, water saturates the windsurfing equipment.

It can be seen from the foregoing description that the instant invention provides a frame for the efficient maintenance of sailboard equipment. Using the apparatus, cleaning the craft is a simple process as compared to the cumbersome means utilized if each part of the equipment were cleaned manually. After one sails for an extended period, ease of maintenance is a significant advantage over conventional methods.

As indicated above, the present invention also serves a number of functions in a practical manner. For example, after the washing and rinsing are completed, the craft can be left on the frame because it can also be used as a drying frame.

Next, the frame can be used as a storage frame.

Lastly, some part of the craft occasionally may need repair. Under such circumstances, the frame is also convenient for close inspection and repair of various parts of the sailboard. Thus, when a problem is encountered and repair is required, the frame can be used as a repair station. Upon placing the craft onto the frame, one can maintain his or her equipment simply, conveniently and efficiently. In each of the maintenance procedures it is possible to assemble the frame without jets since water is not necessary in such operations.

In sum, the present invention is a uniquely configured portable sailboard frame which facilitates maintenance of sailboards, surfboards and similar craft.

While the preferred embodiment of the invention has been described, modification can be made and other embodiments may be devised within the spirit of the invention and the scope of the appended claims.

What is claimed is:

1. A portable frame for washing, rinsing, drying, storing and repairing sailboards, surfboards and similar structures comprising:

a self-standing rack constructed from a plurality of sections comprising at least two pairs of substantially parallel vertical tubular sections;

means in the lower part of said rack for supporting at least one sailboard;

means fixed on said rack for spraying fluid from various directions toward said sailboard, including a plurality of jets mounted on said tubular sections;

means for moving fluid through some of said sections to said spraying means which includes a hose adapter inlet mounted on one of said sections and a plurality of tubular couplings joining said sections together;

at least one spraying branch extending horizontally within said rack, substantially parallel to said side members and disposed in a lower position thereto;

fluid-ducting means for supporting said branch and delivering fluid thereto;

a plurality of jets mounted on said branch;

each of said vertical tubular sections including:

at least two vertical members;

a first horizontal cross member spanning the upper ends of the vertical member;

a second horizontal cross member substantially parallel to said first horizontal cross member and disposed in a lower position thereto;

a third horizontal cross member substantially parallel to said first and second horizontal cross members and disposed in an overlying relation to said first cross member; and at least two pairs of horizontal side members spanning said vertical sections and holding them in substantially parallel positions to each other.

2. The frame in claim 1 wherein said horizontal cross members are removably fastened to said vertical members.

* * * * *